United States Patent [19]

Cramer et al.

[11] 4,386,491

[45] Jun. 7, 1983

[54] APPARATUS FOR SELECTIVELY PACKING LAYERS OF OBJECTS IN BOXES OF DIFFERENT DEPTHS

[75] Inventors: Jerry W. Cramer, Upland; Everett G. LaVars, Pomona, both of Calif.

[73] Assignee: Sunkist Growers, Inc., Sherman Oaks, Calif.

[21] Appl. No.: 207,141

[22] Filed: Nov. 17, 1980

[51] Int. Cl.[3] ..... B65B 39/02; B65B 39/12; B65B 35/38

[52] U.S. Cl. ..... 53/247; 53/261; 193/15; 248/656

[58] Field of Search ..... 53/537, 543, 247, 248, 53/260, 494, 535; 193/15, 7; 248/656, 669

[56] References Cited

U.S. PATENT DOCUMENTS

| | | | |
|---|---|---|---|
| 434,011 | 8/1890 | Wrigley | 248/656 |
| 1,417,096 | 5/1922 | Mueller | 193/15 |
| 3,239,169 | 3/1966 | Sloyan | 248/656 |
| 3,453,802 | 7/1969 | Riddington | 53/247 X |
| 3,590,551 | 7/1971 | Riddington et al. | 53/494 |
| 3,928,942 | 12/1975 | Paddock et al. | 53/247 |

FOREIGN PATENT DOCUMENTS

| | | | |
|---|---|---|---|
| 867029 | 9/1941 | France | 248/656 |

*Primary Examiner*—Horace M. Culver
*Attorney, Agent, or Firm*—Paul A. Weilein

[57] ABSTRACT

Apparatus for packing layers of objects into a box, wherein a pickup head equipped with multiple vacuum cups picks up a layer of the objects and descends into the box. The box is initially positioned in a packing station in an approximately correct position relative to the path of descent of the pickup head and as the pickup head approaches the top of the box, a chute structure is provided in which four guide panels snap into engagement with the four inner walls, respectively, of the box for four purposes: (1) to position the box precisely correctly relative to the path of descent of the pickup head; (2) to crowd the layer of objects on the pickup head together to conform to the dimensions of the box; (3) to guide the pickup head into the box; and (4) to serve as guards to prevent damage to the descending objects by the rim of the box. According to the present invention, the chute structure is arranged so that its elevated position may be suitably varied to maintain the necessary operative relationship between the chute structure and the box at the packing station to accommodate packing runs for boxes of different depths, whereby to provide relatively greater and lesser sized packs of the objects.

7 Claims, 6 Drawing Figures

APPARATUS FOR SELECTIVELY PACKING LAYERS OF OBJECTS IN BOXES OF DIFFERENT DEPTHS

BACKGROUND OF THE INVENTION

This invention relates to an automatic apparatus for packing fruit into successive boxes and, more particularly, relates to the type of apparatus that is disclosed in the Riddington U.S. Pat. No. 3,590,551 entitled AUTOMATIC APPARATUS FOR PACKING ARTICLES IN BOXES, and the Paddock et al. U.S. Pat. No. 3,928,942 entitled MEANS TO GUIDE A LAYER OF OBJECTS INTO A BOX.

Both of the above noted patents utilize a chute structure for guiding the objects or fruit into a box of a predetermined depth, and as presently arranged, the chutes will not operatively cooperate with boxes of lesser depth, as where it is desired to make a run of so-called "half packs".

According to the present invention, it is proposed to provide object packaging apparatus in which the elevated position of the chute may be varied so as to permit greater versatility of the packaging apparatus, wherein the same apparatus may be adjusted for making a run of so-called "full pack" boxes of greater depth, and by making slight adjustments may be utilized for runs of "half pack" boxes of lesser depth.

This desirable feature is obtained by mounting the chute structure on a vertically adjustable platform which permits the chute to be variably adjusted to a proper operative position dependent upon the depth of box that is to be used for the pack.

SUMMARY OF THE INVENTION

More specifically, the present invention relates to improvements in object packaging apparatus such as that disclosed in the Paddock et al. U.S. Pat. No. 3,928,942 to increase its versatility and permit its selective use for packaging layers of objects in runs of boxes having relatively greater or lesser depths.

Having the foregoing in mind, it is an object of the present invention to provide means for vertically adjusting the relative operative positions of the chute and the packaging box so that the lower end of the chute will overlappingly extend into the open upper end of the box, even though the packaging run comprises boxes of relatively greater or lesser depths.

A further object resides in the provision of a vertically adjustable platform support for the guide chute of an object packaging apparatus, whereby the apparatus may be adjusted to operatively pack layers of objects in boxes of greater or lesser relative depths.

It is also an object to mount on the platform according to the previous object, guide rods for guiding and laterally positioning the box and flap members during movement of the box into an object receiving packing position.

Further objects and advantages of the invention will be brought out in the following part of the specification, wherein detailed description is for the purpose of fully disclosing a preferred embodiment of the invention without placing limitations thereon.

BRIEF DESCRIPTION OF THE DRAWINGS

Referring to the accompanying drawings, which are for illustrative purposes only.

DESCRIPTION OF A PREFERRED EMBODIMENT OF THE INVENTION

Figure 1:
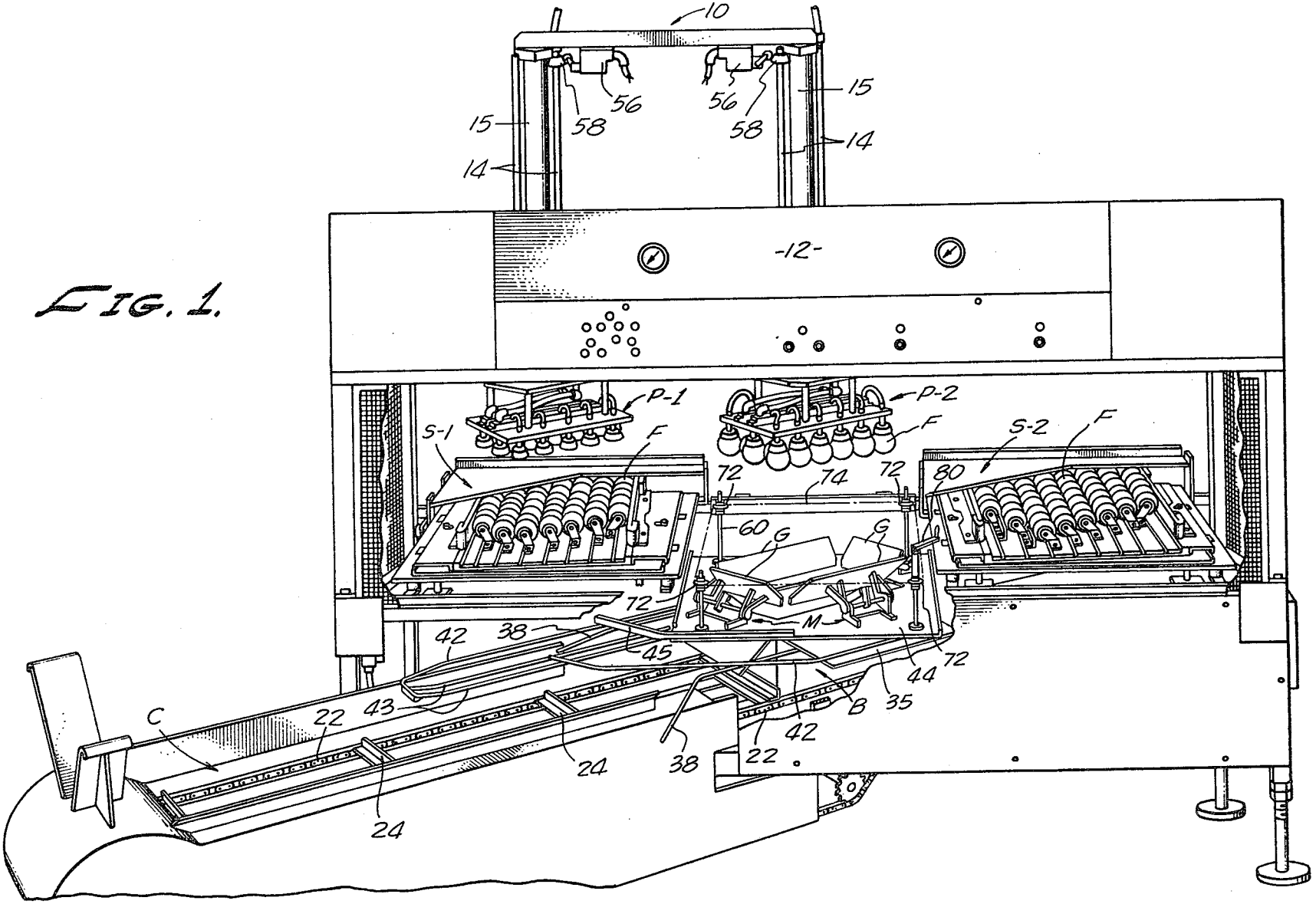
FIG. 1 is a front elevational view of automatic packaging apparatus incorporating the presently preferred embodiment of the invention, portions of the apparatus being broken away to show concealed parts.

Referring more specifically to the drawings, for illustrative purposes, FIG. 1 shows a packing station represented by a box, generally designated B, which has been delivered to the packing station by a conveyor that is generally designated C. Fruit F, in this instance oranges, are packed in the box B in alternate layers that are of complementary patterns to enable them to partially nest together. Therefore, the apparatus provides two separate supply stations comprising a left supply station S-1 and a right supply station S-2. The left station forms the fruit into what may be termed a left pattern and the right station forms the fruit into what may be termed a right pattern, the two patterns being shown in FIG. 2.

To pack the two patterns of fruit into the box B alternately, the apparatus provides a left pickup head P-1 to pick up layers of fruit at the supply station S-1, and a right pickup head P-2 to pick up layers of fruit at the right supply station S-2. The two pickup heads extend downward from a carriage 10 which is largely concealed behind a panel 12 in FIG. 1. The carriage is automatically reciprocated between a left position shown in FIG. 1 where the left pickup head P-1 is poised over the left supply station S-1 and the right pickup head P-2 is poised over the packing station, and an alternate position to the right where the pickup head P-1 is poised over the packing station and the right pickup head P-2 is poised over the right supply station S-2.

When the two pickup heads are at their left positions shown in FIG. 1, the left pickup head P-1 descends to pick up a layer of fruit from the left supply station S-1 and simultaneously the right pickup head P-2 descends to deposit a layer of fruit in the box B. In like manner, when the two pickup heads are at their right positions the left pickup head P-1 descends to deposit a layer of fruit in the box B and simultaneously the right pickup head P-2 descends to pick up a layer of fruit at the right supply station S-2.

Each of the two pickup heads is mounted on a corresponding pair of guide rods 14 which extend through guide sleeves (not shown) on the carriage 10 and each of the pickup heads is reciprocated vertically by a corresponding air cylinder 15.

Figure 3:
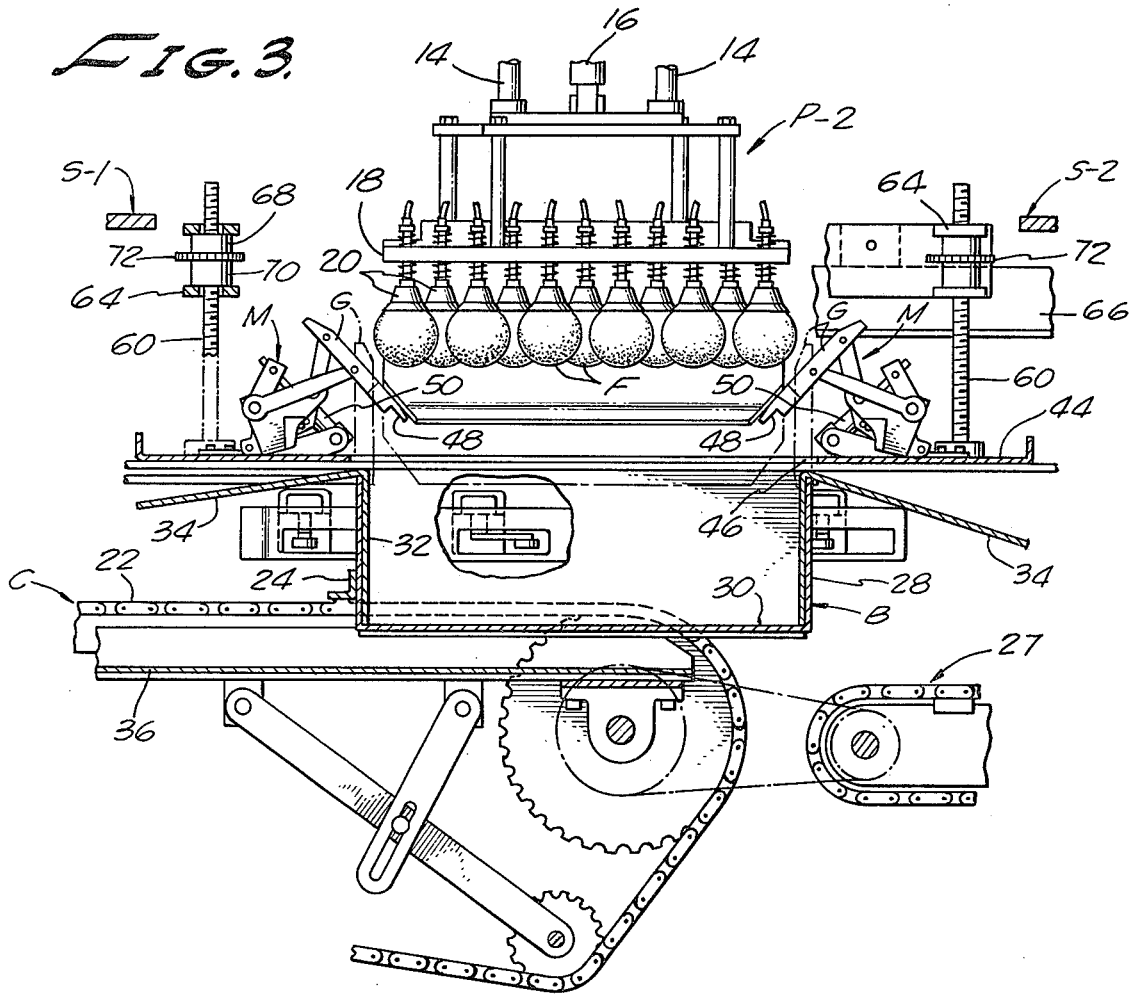
FIG. 3 is a fragmentary vertical sectional view taken substantially on line 3—3 of FIG. 2 and longitudinally of a box at a packing station, and showing a pickup head with a layer of fruit thereon descending towards the box.

The construction of a pickup head is best shown in FIG. 3 where the pickup head is connected to the lower ends of the corresponding guide rods 14 and is also connected to a piston rod 16 that extends downward from the corresponding air cylinder 15. FIG. 3 also shows how the structure of a pickup head includes a head plate 18 that carries on its underside a set of vacuum cups 20 with the vacuum cups arranged in a pattern that corresponds to the pattern of the fruit at the corresponding supply station S-1 or S-2. An automatic control system makes or breaks the vacuums in the vacuum cups as required for picking up fruit at a supply station or for releasing fruit in a box B.

Figure 4:
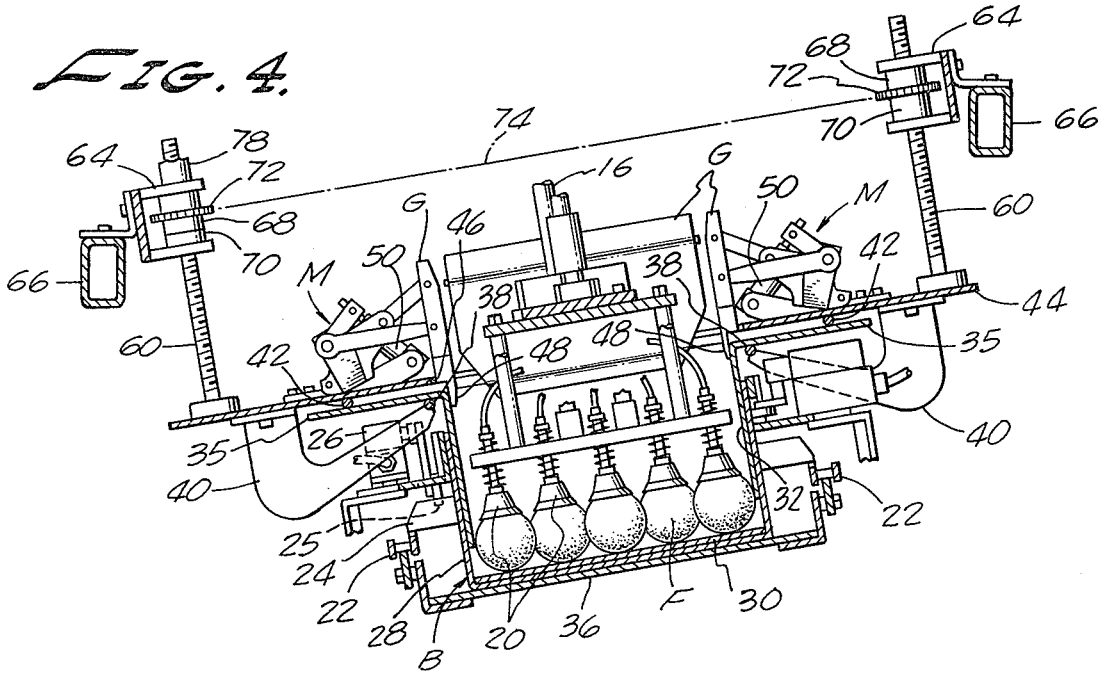
FIG. 4 is a fragmentary vertical sectional view taken substantially on line 4—4 of FIG. 2 and transversely of the box at the packing station, and showing the pickup head with a layer of fruit thereon at its delivery position within the box.

The conveyor C has a pair of spaced parallel conveyor chains 22 shown in FIGS. 1, 3 and 4 which are interconnected by spaced pusher bars 24 that push the successive boxes to the packing station. As shown in FIG. 4, when a box reaches the packing station the pusher bar 24 that propels the box encounters an operating arm 25 of a stop switch 26 to stop the conveyor and subsequently the conveyor is again activated to move a new empty box to the packing station and to move the filled box out of the packing station onto a discharge conveyor that is generally designated 27 in FIG. 3.

Each of the boxes B is a conventional orange packing box that is made in two sections to permit vertical expansion and contraction of the box as required for confining different volumes of fruit. A bottom section 28 of the box has four flaps which are glued together to form a double thickness bottom wall 30. An upper box section 32 which is bottomless and which is slidingly mounted in the bottom section 28 has two outwardly extending end flaps 34 shown in FIG. 3 and has two longitudinal outwardly extending side flaps 35 shown in FIG. 4.

In a manner well known in the art, each of the boxes B is initially elevated to space the bottom wall 30 of the box above the platform 36 of the packing station as shown in FIG. 3. For this purpose, as shown in FIG. 4, each of the side flaps 35 encounters a corresponding fixed rod 38 which is supported by suitable brackets 40 and which is inclined upward to lift each flap against a corresponding fixed upper rod 42. A pair of spaced elongate rods 43 are secured to a bracket arm 45 carried by the support plate 44, and extend centrally across the top end of a box on the conveyor to hold down the end flaps 34 of the box as it is moved by the conveyor into the boxing station. The first layer of fruit that is deposited in the elevated box by a pickup head pushes against the bottom wall 30 of the box to shift the bottom wall from the elevated position shown in FIG. 3 to the lower position shown in FIG. 4 where the bottom wall of the box rests on the platform 36 of the packing station. Thus, each of the successive boxes is expanded at the start of each packing cycle.

Four guide panels G are carried by four corresponding mechanisms designated M in various figures of the drawings, and the four mechanisms M are mounted on a platform support plate 44 which, as shown in FIG. 4, is provided with a rectangular opening 46 that is positioned above the box at the packing station and is slightly larger in area than the interior of the box to provide clearance for the operation of the guide panels G.

The apparatus as thus far described is identical to the apparatus disclosed in the above mentioned Paddock et al patent, which is incorporated herein by reference, and in which the mechanism M for actuating each of the guide panels G is described in detail.

Briefly, each mechanism M embodies an articulated linkage arrangement which supports a panel G and is operable to shift the panel G to the two limit positions shown in FIGS. 3 and 4, respectively.

With all four of the linkage mechanisms M at their limit positions shown in FIG. 3, the four guide panels G are at upper poised positions at which each guide panel overhangs a corresponding side wall of the box B and is inclined downwardly towards the interior of the box. When peripheral fruit of a descending layer of fruit encounters the poised guide panels, the descending fruit forces each of the four linkage mechanisms to move the four guide panels to their opposite limit positions illustrated by FIG. 4 at which the four guide panels are substantially upright with a downwardly extending lip 48 of each guide panel engaging the inner rim of the corresponding wall of the box.

Figure 2:
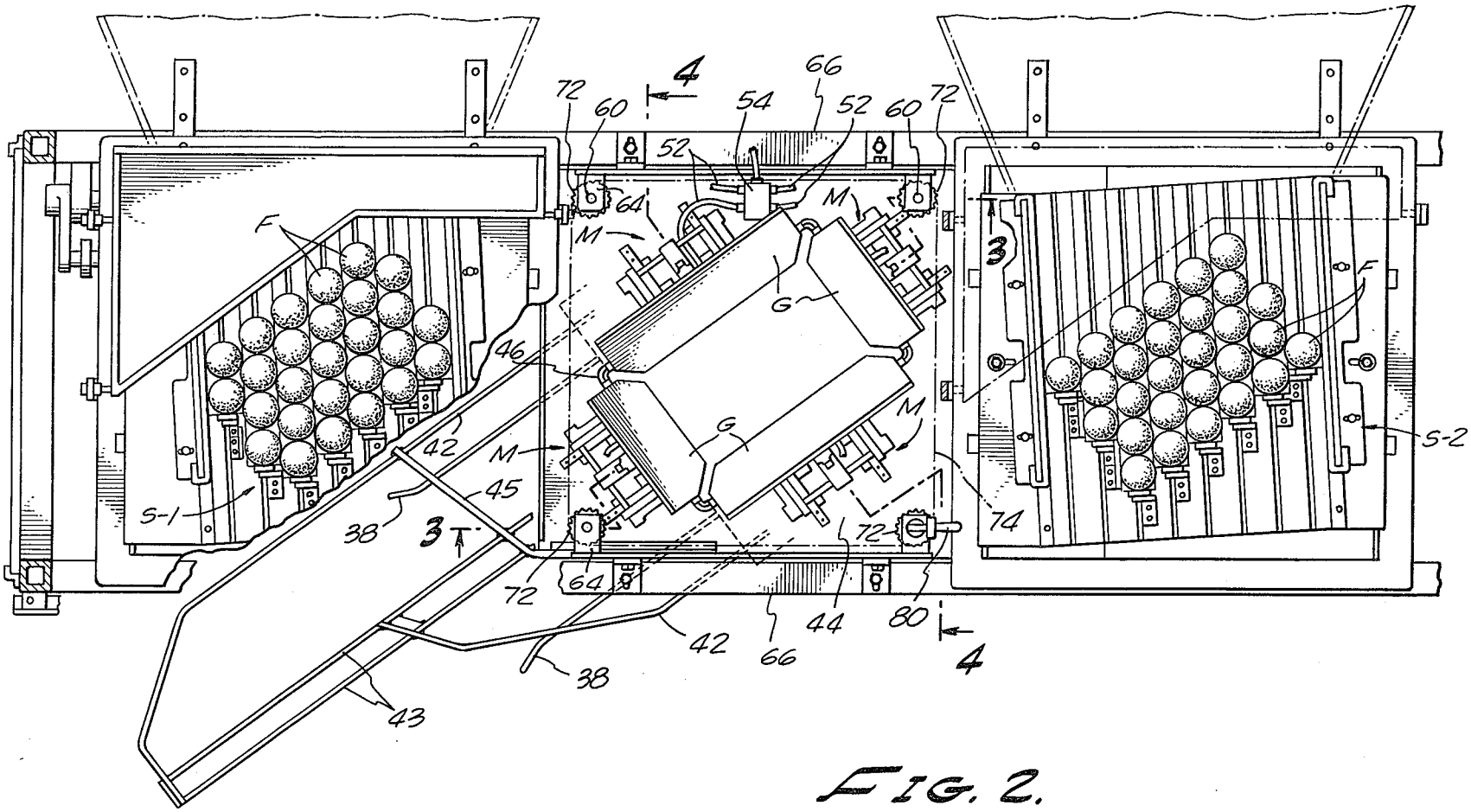
FIG. 2 is an enlarged fragmentary plan view showing details of the adjustable support for the guide chute at the packing station and the two supply stations on opposite sides thereof.

Each of the four linkage mechanisms M includes a power cylinder 50 that may be energized by compressed air to return the corresponding guide panel to its upper poised position. Each power cylinder 50 is connected to a corresponding flexible air line 52 (FIG. 2). The four flexible air lines 52 are connected to a common manifold 54 shown in FIG. 2 and compressed air is supplied to the manifold through a suitable normally closed solenoid valve (not shown).

Switches 56, as shown in FIG. 1, are positioned on the carriage structure adjacent the two slidable guide rods 14, respectively, and are operated by corresponding collars 58 on the guide rods. The switches are operated whenever an empty pickup head returns from a box to an elevated position with the consequence that all four of the power cylinders 50 are energized to snap the four guide panels G from their lower upright positions to their upper poised positions.

The manner in which the four guide panels G function for their purpose may be readily understood from the foregoing description. With each of the guide panels G at its upper poised position shown in FIG. 3, the peripheral fruit of a descending layer of fruit impinges on the four guide panels at points which will cause the guide panels to move downward in arcuate paths towards their lower upright positions. Since the guide panels yield arcuately downwardly to the downwardly moving peripheral fruit of the descending layer, relative movement between the peripheral fruit and the surface of the guide panels is minimal with consequent minimum friction action on the descending fruit. When the four poised guide panels are moved downward to their upright positions, as shown in FIG. 4, two opposite guide panels will act on the opposite end walls of the box to center the box longitudinally relative to the path of the descending fruit and the other two opposite panels will act on the opposite side walls of the box to center the box laterally.

It is apparent that the four guide panels G in their lower upright positions cooperate to form a four-walled guide enclosure or guide chute that leads to the interior of the box, the guide chute being dimensioned to contract the descending layer of fruit to the dimensions of the interior of the box. Thus, in effect, the guide chute is repeatedly assembled and disassembled in the course of packing fruit into a box.

In the structure of the previously noted patents, the guide chutes are mounted on a fixed platform, and as so arranged the packaging apparatus is limited to the packing of layers of objects in boxes of a single predetermined depth. Thus, in these prior arrangements it was not possible to have a packaging run of boxes of a greater or lesser relative depth.

The present invention proposes to solve this problem and increase the versatility of the prior packaging apparatus by mounting the support plate 44 so that it may be vertically relatively adjusted to change the operative position of the chute formed by the four panels G so as to accommodate packaging runs of boxes of greater or lesser depths and thus provide for the selective packaging of so-called "full packs" and "half packs" of the objects.

While this feature has been disclosed as being accomplished by varying the elevated position of a chute structure, it will be evident that the same results may be obtained by utilizing a fixed platform support for the chute structure, and by providing suitable means for vertically varying the operating level of the conveyor chains 22 in a manner to maintain the upper ends of the packaging boxes in a correct operative relationship with respect to the chute structure, irrespective of the depth of the box.

Figure 5:
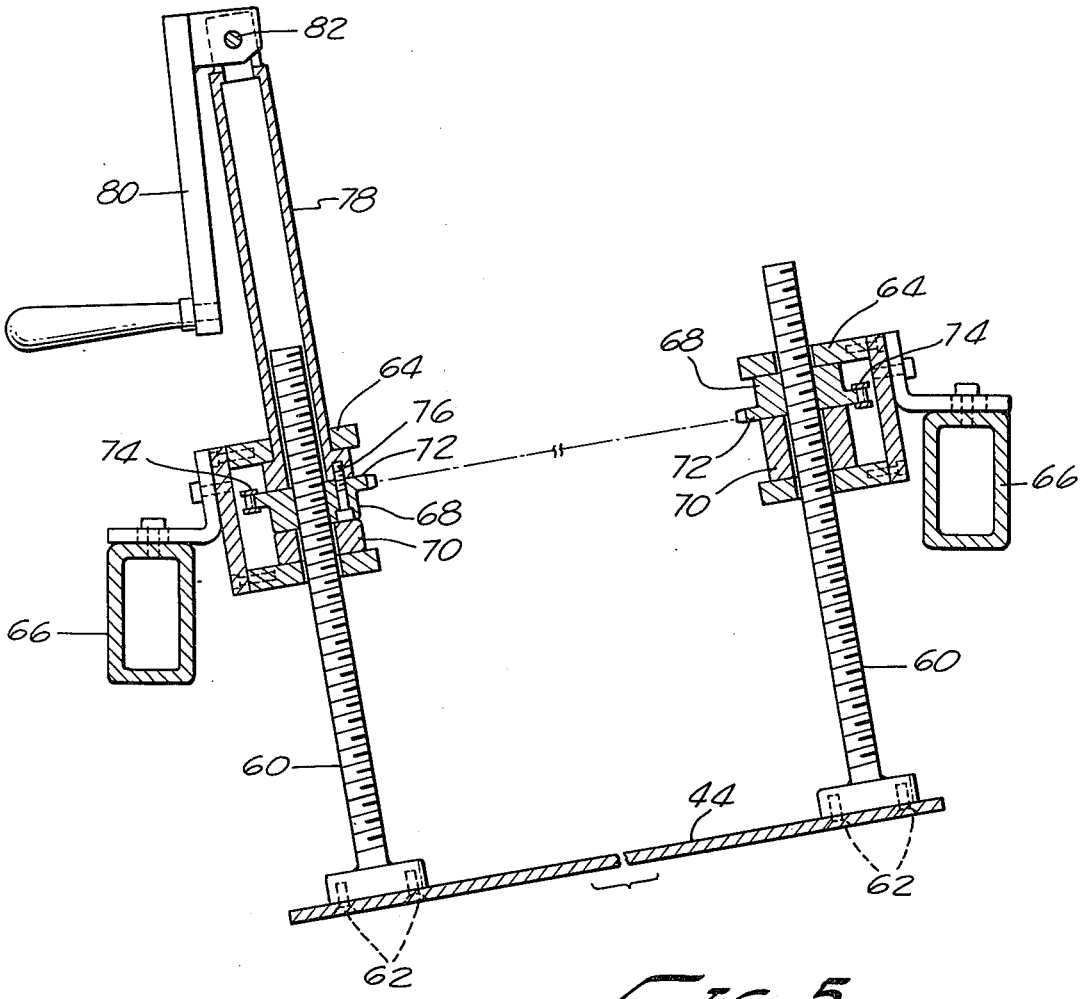
FIG. 5 is an enlarged fragmentary sectional view showing structural details of the adjustable support for raising and lowering the operative position of the guide chute.
Figure 6:
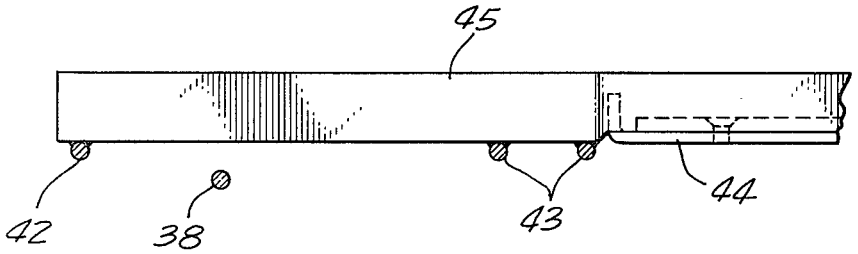
FIG. 6 is a fragmentary elevational view, partly in section, and showing details of the guide rods for the box and the top flaps of the box.

More specifically, as shown in FIGS. 3, 4 and 5, the platform 44 is arranged to be supported at the four corners of its rectangular configuration by means of upstanding threaded rod members 60. The lower end of each of the rod members is secured as by retaining screws 62. The other ends of the rod members 60 are respectively supported in each case by an appropriate bracket 64 which is fixedly supported in each case from an adjacent portion of the apparatus frame structure 66. Each of the brackets 64 is apertured for the through passage of the associated threaded rod member, and rotatably mounts a nut 68 in each case upon a supporting thrust bearing 70. The nut 68 in each case threadedly engages the associated threaded rod 60, and upon rotation of the nut in opposite directions it will coact with the associated threaded rod 60 to raise and lower it with respect to the fixed supporting brackets 64. Depending upon the adjusted positions of the threaded rods, the platform plate 44 will be adjustably positioned to assume varied elevated positions, and thus adapt the chute structure for proper cooperative relationship to accommodate runs of packaging boxes having greater or lesser depth.

It will be appreciated that in adjusting the elevated position of the platform 44, it is desirable that all of the nuts 68 should be simultaneously actuated in order to prevent tilting of the platform 44 and prevent binding of the actuating nut on its associated threaded rod. To accomplish this purpose, each of the nuts 68 is fabricated to provide a drive sprocket 72 thereon. Synchronized operation of the four nuts is then accomplished by means of a looped sprocket chain 74 having trained engagement with all of the sprockets 72, so that if one of the sprockets is driven, all of the other sprockets will be operative in synchronized relation and thus raise or lower the threaded rods 60 and the connected platform 44.

As best shown in FIG. 5, one of the nuts 72 is connected as by a retaining bolt 76 with the lowermost end of an upstanding tubular sleeve 78 which is rotatably mounted in the associated bracket 64 in axial alignment with the associated threaded rod 60. As thus mounted, the tubular sleeve 78 receives the upper end portion of the threaded rod for axial movements therein during raising and lowering movements of the platform 44. The upper end of the tubular sleeve 78 pivotally supports a hand crank 80 for swinging movement on a pivot pin 82 which permits the crank to be selectively positioned in an operative cranking position for turning the sleeve 78 or in a folded non-cranking position.

From the foregoing description and drawings, it will be clearly evident that the delineated objects and features of the invention will be accomplished.

Various modifications may suggest themselves to those skilled in the art without departing from the spirit of the disclosed invention and, hence, it is not wished to be restricted to the specific form shown or uses mentioned, except to the extent indicated in the appended claims.

We claim:

1. In an apparatus for automatically packing layers of objects into boxes successively delivered to a packing station, wherein a pickup head successively picks up layers of the objects and descends briefly into a box to deposit each layer therein, a guide chute, a fixed platform for supporting the guide chute in operative relation with a box of a predetermined height only from which it extends upwardly and defines a zone of approach to the box, said chute being shaped and dimensioned to surround each layer of objects on said pickup head as the layer descends to the box and to confine the layer of objects to the inside dimensions of the box, the improvement comprising:

an adjustable support for said platform including means for selectively raising and lowering said platform to accommodate packing runs for boxes of different depths, whereby to provide relatively greater and lesser packs of the objects in a single apparatus.

2. Apparatus as set forth in claim 1, in which the adjustable support for said platform comprises:

guide rods carried by and movable with said adjustably supported platform to guide and laterally position the box and flap members thereon during movement of the box into a pickup head receiving position at the packing station.

3. Apparatus as set forth in claim 1, in which:

the means for selectively raising and lowering said platform comprises platform supporting screw means positioned in its entirety above said platform.

4. Apparatus as set forth in claim 1, in which:

the platform is of generally rectangular configuration; and the means for selectively raising and lowering the platform comprises:

a plurality of upstanding threaded rod members having their lower ends fixedly secured to said platform;

nut members respectively threadedly engaged with the rod members;

means rotatably supporting each of the nut members on adjacent frame portions of the apparatus above said platform; and means for simultaneously rotating said nut members.

5. Apparatus as set forth in claim 4, in which:

a sprocket wheel is secured to each of said nuts;

a sprocket chain is trained over the sprocket wheels; and an actuating crank is drivingly connected with one of said sprocket wheels.

6. Apparatus as set forth in claim 5, wherein the supporting means for each of said nut members comprises a fixed bracket; and a thrust bearing underlies each of the nut members.

7. Apparatus as set forth in claim 6, in which:

a tubular sleeve extends upwardly from one of said sprockets, said sleeve being secured at its lower end to said one of said sprocket wheels and being axially aligned with the nut to receive the associated threaded rod axially therein; and an actuating crank is pivotally connected to the upper end of the sleeve for swinging movements to cranking and non-cranking positions.

* * * * *